US012050038B2

(12) United States Patent
Fukuyama et al.

(10) Patent No.: US 12,050,038 B2
(45) Date of Patent: Jul. 30, 2024

(54) REFRIGERATION CYCLE SYSTEM

(71) Applicant: DAIKIN INDUSTRIES, LTD., Osaka (JP)

(72) Inventors: Yuuta Fukuyama, Osaka (JP); Shinya Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 395 days.

(21) Appl. No.: 17/569,034

(22) Filed: Jan. 5, 2022

(65) Prior Publication Data

US 2022/0128277 A1 Apr. 28, 2022

Related U.S. Application Data

(63) Continuation of application No. PCT/JP2020/026928, filed on Jul. 9, 2020.

(30) Foreign Application Priority Data

Jul. 12, 2019 (JP) ..... 2019-130644

(51) Int. Cl.
*F25B 41/24* (2021.01)
*F25B 13/00* (2006.01)

(52) U.S. Cl.
CPC ..... *F25B 41/24* (2021.01); *F25B 13/00* (2013.01)

(58) Field of Classification Search
CPC .... F25B 41/24; F25B 13/00; F25B 2500/222; F25B 49/005; F24F 11/36; F24F 11/54;
(Continued)

(56) References Cited

U.S. PATENT DOCUMENTS

2018/0045424 A1* 2/2018 Yajima ..... F24F 7/007

FOREIGN PATENT DOCUMENTS

CN 102954614 A * 3/2013 ..... F25B 49/02
EP 3270069 A2 * 1/2018 ..... F24F 1/32
(Continued)

OTHER PUBLICATIONS

International Preliminary Report of corresponding PCT Application No. PCT/JP2020/026928 dated Jan. 27, 2022.
(Continued)

*Primary Examiner* — Kun Kai Ma
(74) *Attorney, Agent, or Firm* — Global IP Counselors, LLP

(57) ABSTRACT

A refrigeration cycle system includes a refrigeration cycle, a communication line, a refrigerant sensor to detect a refrigerant leak, a safety device, and a first electric wire different from the communication line. The refrigeration cycle unit includes utilization-side and heat source-side units connected by refrigerant connection pipe. The sensor is connected to the utilization-side unit. The safety device includes at least one of an alarm that makes a notification of refrigerant leak upon detection by the sensor, a ventilation device that operates upon detection of the leak, and a shutoff valve device that closes a shutoff valve on the pipe upon detection of the leak. The first electric wire is dedicated for interlock and connects between the utilization-side unit and safety device. The heat source-side unit is prohibited from operation when the utilization-side unit is not connected to the safety device via the first electric wire.

16 Claims, 4 Drawing Sheets

(58) Field of Classification Search
CPC ..... F24F 11/526; F24F 11/56; F24F 11/84; F24F 11/86; F24F 11/88
See application file for complete search history.

(56) References Cited

FOREIGN PATENT DOCUMENTS

| | | | | | |
|---|---|---|---|---|---|
| EP | 3 434 997 | A2 | | 1/2019 | |
| JP | 55-174647 | U | | 12/1980 | |
| JP | 61-250569 | A | | 11/1986 | |
| JP | H10170133 | A | * | 6/1998 | |
| JP | 2002-232359 | A | | 8/2002 | |
| JP | 2011-94940 | A | | 5/2011 | |
| JP | 2013040730 | A | * | 2/2013 | ..... F25B 49/02 |
| JP | 2016-211762 | A | | 12/2016 | |
| JP | 2019-27663 | A | | 2/2019 | |
| JP | 2019-113258 | A | | 7/2019 | |

OTHER PUBLICATIONS

International Search Report of corresponding PCT Application No. PCT/JP2020/026928 dated Sep. 24, 2020.
European Search Report of corresponding EP Application No. 20 83,9831.3 dated Jun. 21, 2023.

* cited by examiner

REFRIGERATION CYCLE SYSTEM

CROSS-REFERENCE TO RELATED APPLICATIONS

This is a continuation of International Application No. PCT/JP2020/026928 filed on Jul. 9, 2020, which claims priority to Japanese Patent Application No. 2019-130644, filed on Jul. 12, 2019. The entire disclosures of these applications are incorporated by reference herein.

BACKGROUND

Field of Invention

The present disclosure relates to a refrigeration cycle system. More specifically, the present disclosure relates to a refrigeration cycle system including a refrigeration cycle unit and a safety device operable upon detection of a refrigerant leak.

Background Information

Some refrigeration cycle systems include a safety device as a safeguard against a refrigerant leak. For example, JP 2016-211762 A discloses a refrigeration cycle system including a ventilation device as a safety device.

Such a refrigeration cycle system is required to have high reliability so as to prevent occurrence of a situation in which a safety device does not work when a refrigerant leaks during an operation of a refrigeration cycle apparatus. In view of this, according to the refrigeration cycle system disclosed in JP 2016-211762 A, a controller of a refrigeration cycle apparatus is capable of sending an operation command to the ventilation device through a communication line in the refrigeration cycle apparatus and the refrigeration cycle apparatus is prohibited from operation if the controller fails to communicate with the ventilation device. With this configuration, the refrigeration cycle system can reduce occurrence of a situation in which the refrigeration cycle apparatus operates while being in a condition that the ventilation device does not work.

SUMMARY

A refrigeration cycle system according to a first aspect includes a refrigeration cycle, a communication line configured to be used for control signal communication in the refrigeration cycle unit, a refrigerant sensor, a safety device, and a first electric wire. The refrigeration cycle unit includes a utilization-side unit, and a heat source-side unit connected to the utilization-side unit via a refrigerant connection pipe. The refrigerant sensor is connected to the utilization-side unit so as to communicate with the utilization-side unit. The refrigerant sensor is configured to detect a refrigerant leak. The safety device includes at least one of an alarm configured to make a notification of a refrigerant leak upon detection of the refrigerant leak by the refrigerant sensor, a ventilation device configured to operate upon detection of the refrigerant leak, and a shutoff valve device configured to close a shutoff valve on the refrigerant connection pipe upon detection of the refrigerant leak. The first electric wire is dedicated for interlock. The first electric wire connects between the utilization-side unit and the safety device. The first electric wire is different from the communication line. The heat source-side unit is prohibited from operation in a case in which the utilization-side unit is not connected to the safety device via the first electric wire.

The case in which the utilization-side unit is not connected to the safety device via the first electric wire as used herein includes a case in which the first electric wire is not provided, a case in which the first electric wire is broken, and a case in which the first electric wire is detached from a terminal or the like.

DETAILED DESCRIPTION OF EMBODIMENT(S)

A description will be given of a refrigeration cycle system according to an embodiment of the present disclosure.

(1) General Outline

A refrigeration cycle system according to the present disclosure is configured to cool or heat a target to be cooled or heated, using a vapor compression refrigeration cycle.

Figure 1:
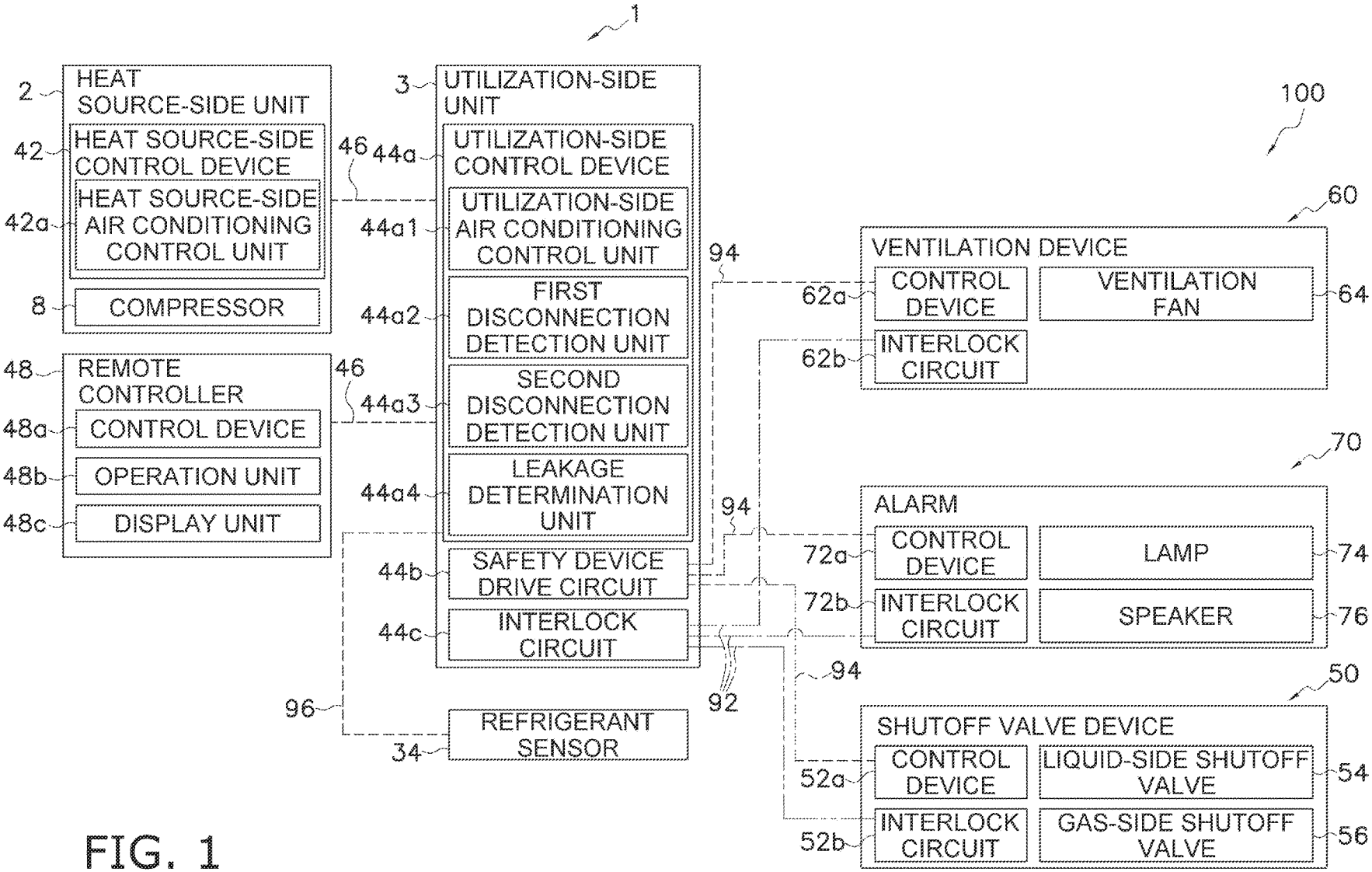
FIG. 1 is a block diagram of an air conditioning system as an example of a refrigeration cycle system.
Figure 2:
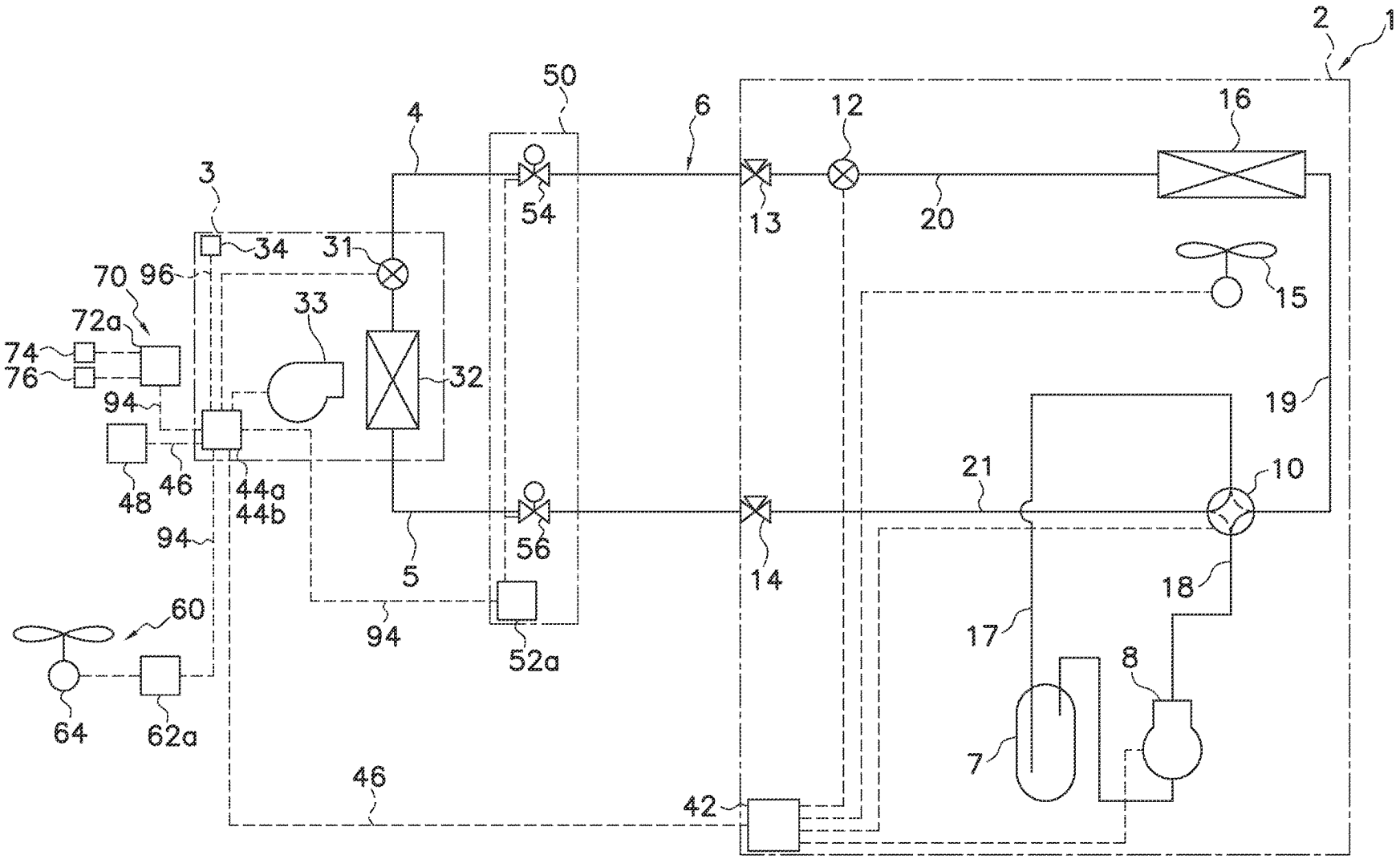
FIG. 2 is a schematic configuration diagram of an air conditioning unit of the air conditioning system illustrated in FIG. 1.

With reference to FIGS. 1 and 2, a description will be given of an air conditioning system 100 as an example of the refrigeration cycle system according to the present disclosure. FIG. 1 is a block diagram of the air conditioning system 100. FIG. 2 is a schematic configuration diagram of an air conditioning unit 1 of the air conditioning system 100. It should be noted that FIG. 1, which illustrates the air conditioning unit 1, does not depict constituent components of a refrigerant circuit 6 except a compressor 8 of a heat source-side unit 2, a heat source-side fan 15, and a utilization-side fan 33.

It should be noted that the air conditioning system 100 is merely an example of a refrigeration cycle system. The refrigeration cycle system according to the present disclosure is not limited to the air conditioning system 100. For example, the refrigeration cycle system according to the present disclosure may alternatively be a cold storage system or a refrigeration system configured to cool a space therein with a refrigeration cycle, a hot water supply system or an underfloor heating system configured to heat a liquid such as water with a refrigeration cycle.

The air conditioning system 100 according to this embodiment is configured to cool or heat air for air conditioning of an air conditioning target space. As illustrated in FIG. 1, the air conditioning system 100 includes the air conditioning unit 1 configured to condition air in the air conditioning target space, a refrigerant sensor 34 configured to detect a refrigerant leak, and a safety device operable upon detection of a refrigerant leak by the refrigerant sensor 34. The air conditioning unit 1 includes a utilization-side unit 3 and the heat source-side unit 2. As illustrated in FIG. 1, the air conditioning system 100 according to this embodiment includes as safety devices, an alarm 70, a ventilation device 60, and a shutoff valve device 50. The air conditioning system 100 does not necessarily include as safety devices all the alarm 70, the ventilation device 60, and the shutoff valve device 50. For example, the air conditioning system 100 may include one of the alarm 70, the ventilation device 60, and the shutoff valve device 50. Alternatively, the air conditioning system 100 may include the alarm 70 and one of the ventilation device 60 and the shutoff valve device 50. As illustrated in FIG. 1, the air conditioning system 100 also includes communication lines 46, first electric wires 92, second electric wires 94, and a signal line 96.

(2) Specific Configuration

Next, a description will be given of the communication lines 46, the first electric wires 92, the second electric wires 94, the signal line 96, the air conditioning unit 1, the refrigerant sensor 34, the alarm 70, the ventilation device 60, and the shutoff valve device 50. In the following, the term "safety device" refers to a group of the alarm 70, the ventilation device 60, and the shutoff valve device 50, for the sake of simplification of the description.

(2-1) Communication Line, First Electric Wire, Second Electric Wire, Signal Line A description will be given of the communication lines 46, the first electric wires 92, the second electric wires 94, and the signal line 96. In the following, an expression "a communication line 46, a first electric wire 92, a second electric wire 94, or a signal line 96 connects a device A to a device B" is used in some cases. This expression includes a case where a device A and a device B are directly connected to each other via a communication line 46, a first electric wire 92, a second electric wire 94, or a signal line 96 and a case where a device A and a device B are connected to each other via a communication line 46, a first electric wire 92, a second electric wire 94, or a signal line 96 with a relay device interposed therebetween. Even though the illustration indicates that a device A and a device B are directly connected to each other via a communication line 46, a first electric wire 92, a second electric wire 94, or a signal line 96, it may be interpreted that a relay device is interposed between the device A and the device B.

The communication lines 46, the first electric wires 92, the second electric wires 94, and the signal line 96 are different from one another. The communication lines 46, the first electric wires 92, the second electric wires 94, and the signal line 96 are used for different purposes.

The communication lines 46 are used for control signal communications in the air conditioning unit 1. One of the communication lines 46 connects between the heat source-side unit 2 and the utilization-side unit 3. The other communication line 46 connects between the utilization-side unit 3 and a remote controller 48. Connection work for the communication lines 46 is conducted in installing or replacing the heat source-side unit 2, utilization-side unit 3, or remote controller 48 in the air conditioning unit 1, for example.

Each of the first electric wires 92 is an electric wire dedicated for interlock and connecting between the air conditioning unit 1 and the safety device. One of the first electric wires 92 connects between the utilization-side unit 3 of the air conditioning unit 1 and the alarm 70. Another one of the first electric wires 92 connects between the utilization-side unit 3 of the air conditioning unit 1 and the ventilation device 60. Still another one of the first electric wires 92 connects between the utilization-side unit 3 of the air conditioning unit 1 and the shutoff valve device 50. Specifically, one of the first electric wires 92 connects between an interlock circuit 44*c* of the utilization-side unit 3 and an interlock circuit 72*b* of the alarm 70. Another one of the first electric wires 92 connects between the interlock circuit 44*c* of the utilization-side unit 3 and an interlock circuit 62*b* of the ventilation device 60. Still another one of the first electric wires 92 connects between the interlock circuit 44*c* of the utilization-side unit 3 and an interlock circuit 52*b* of the shutoff valve device 50. Connection work for the first electric wires 92 is conducted in installing or replacing the air conditioning unit 1 or the safety device, for example.

Each of the second electric wires 94 is an electric wire for controlling an operation of the safety device. One of the second electric wires 94 connects between the utilization-side unit 3 of the air conditioning unit 1 and the alarm 70. Another one of the second electric wires 94 connects between the utilization-side unit 3 of the air conditioning unit 1 and the ventilation device 60. Still another one of the second electric wires 94 connects between the utilization-side unit 3 of the air conditioning unit 1 and the shutoff valve device 50. Specifically, one of the second electric wires 94 connects between a safety device drive circuit 44*b* and a control device 72*a* of the alarm 70. Another one of the second electric wires 94 connects between the safety device drive circuit 44*b* and a control device 62*a* of the ventilation device 60. Still another one of the second electric wires 94 connects between the safety device drive circuit 44*b* and a control device 52*a* of the shutoff valve device 50. When the refrigerant sensor 34 detects a refrigerant leak, the safety device drive circuit 44*b* transmits a signal to the safety device via the second electric wire 94 such that the safety device carries out an operation upon detection of a refrigerant leak. Connection work for the second electric wires 94 is conducted in installing or replacing the air conditioning unit 1 or the safety device, for example.

The first electric wires 92 may be completely independent of the second electric wires 94 so that connection work for connecting between the utilization-side unit 3 and the safety device with the first electric wire 92 and connection work for connecting between the utilization-side unit 3 and the safety device with the second electric wire 94 are conducted separately. According to a different embodiment, a cable including a plurality of electric wires may connect between the utilization-side unit 3 and the safety device, some of the electric wires in the cable may serve as the first electric wires 92, and the remaining electric wires in the cable may serve as the second electric wires 94.

The signal line 96 connects between the utilization-side unit 3 of the air conditioning unit 1 and the refrigerant sensor 34 to allow the utilization-side unit 3 to communicate with the refrigerant sensor 34. Specifically, the signal line 96 connects a utilization-side control device 44*a* of the utilization-side unit 3 and the refrigerant sensor 34 to allow the utilization-side control device 44*a* to communicate with the refrigerant sensor 34. The refrigerant sensor 34 is configured to output a detection signal, upon detection of the existence of a refrigerant near the refrigerant sensor 34. The refrigerant sensor 34 transmits the detection signal to the utilization-side control device 44*a* via the signal line 96.

In the air conditioning system 100, the communication lines 46 for control signal communications in the air conditioning unit 1, the first electric wires 92 dedicated for interlock of the air conditioning unit 1, and the second electric wires 94 for transmission of safety device control signals are different from one another. Therefore, interlocking signals and safety device control signals does not affect control signal communications in the air conditioning unit 1.

Typically, the number of devices that establish communications using the communication lines 46 is limited due to, for example, communication specifications. For this reason, in a case where the communication lines 46 are used for other purposes in addition to the control signal communications in the air conditioning unit 1, the number of devices, such as the utilization-side unit 3, connectable to the communication lines 46 may be limited. Increasing the number of devices that establish communications with the communication lines 46 beyond this limited number may lead to an increase in cost of communication devices and the like for achieving such communications. In view of this, the communication lines 46 for control signal communications in the air conditioning unit 1, the first electric wires 92 dedicated for interlock, and the second electric wires 94 for transmission of safety device control signals are provided separately in the air conditioning system 100 according to the present disclosure. With regard to the disadvantage described above, the air conditioning system 100 according to the present disclosure thus can control a plurality of utilization-side units 3 and the like using the communication lines 46 while suppressing an increase in cost.

(2-2) Air Conditioning Unit

The air conditioning unit 1 is configured to perform a vapor compression refrigeration cycle, thereby cooling and heating an air conditioning target space. Examples of the air conditioning target space may include, but not limited to, spaces in buildings such as an office building, a commercial facility, and a residence. The air conditioning unit 1 is not necessarily configured to cool and heat the air conditioning target space. For example, the air conditioning unit 1 may be configured to cool or heat the air conditioning target space.

As illustrated in FIG. 2, the air conditioning unit 1 mainly includes the heat source-side unit 2, the utilization-side unit 3, refrigerant connection pipes, and the remote controller 48. The heat source-side unit 2 includes a heat source-side control device 42. The utilization-side unit 3 includes the utilization-side control device 44*a*, the safety device drive circuit 44*b*, and the interlock circuit 44*c*.

The refrigerant connection pipes include a liquid-refrigerant connection pipe 4 and a gas-refrigerant connection pipe 5. The liquid-refrigerant connection pipe 4 and the gas-refrigerant connection pipe 5 connect between the heat source-side unit 2 and the utilization-side unit 3. In the air conditioning unit 1, the heat source-side unit 2 and the utilization-side unit 3 are connected via the refrigerant connection pipes 4 and 5 to constitute the refrigerant circuit 6.

The safety device drive circuit 44*b* is configured to control the operation of the safety device in a case where the refrigerant sensor 34 detects a refrigerant leak. Specifically, in a case where the refrigerant sensor 34 detects a refrigerant leak, the safety device drive circuit 44*b* transmits a signal to the alarm 70 via the corresponding second electric wire 94 such that the alarm 70 carries out a refrigerant leak notification operation. In a case where the refrigerant sensor 34 detects the refrigerant leak, the safety device drive circuit 44*b* also transmits a signal to the ventilation device 60 via the corresponding second electric wire 94 such that the ventilation device 60 starts to operate a ventilation fan 64. In a case where the refrigerant sensor 34 detects the refrigerant leak, the safety device drive circuit 44*b* also transmits a signal to the shutoff valve device 50 via the corresponding second electric wire 94 such that the shutoff valve device 50 closes a liquid-side shutoff valve 54 and a gas-side shutoff valve 56.

The refrigerant in the refrigerant circuit 6 is flammable; however, the refrigerant is not limited to a flammable refrigerant. Examples of the flammable refrigerant may include, but not limited to, higher flammability refrigerants classified as Class 3, lower flammability refrigerants classified as Class 2, and slightly combustible refrigerants classified as Subclass 2L, in U.S. ASHRAE Standard 34 (Designation and safety classification of refrigerant) or ISO817 (Refrigerants—Designation and safety classification).

Examples of the refrigerant to be used herein may include, but not limited to, R1234yf, R1234ze(E), R516A, R445A, R444A, R454C, R444B, R454A, R455A, R457A, R459B, R452B, R454B, R447B, R32, R447A, R446A, and R459A.

This embodiment employs R32 as the refrigerant. It should be noted that the present disclosure is applicable to a case where a used refrigerant is not flammable.

As illustrated in FIG. 2, the air conditioning unit 1 includes one heat source-side unit 2. As illustrated in FIG. 2, the air conditioning unit 1 includes one utilization-side unit 3. The air conditioning unit 1 may alternatively include one heat source-side unit 2 and a plurality of utilization-side units 3 connected in parallel to the heat source-side unit 2. The air conditioning unit 1 may alternatively include a plurality of heat source-side units 2.

Next, a specific description will be given of each of the heat source-side unit 2, the utilization-side unit 3, the refrigerant connection pipes 4 and 5, the heat source-side control device 42, the utilization-side control device 44*a*, and the remote controller 48.

(2-2-1) Heat Source-Side Unit

With reference to FIG. 2, a description will be given of an exemplary configuration of the heat source-side unit 2.

The heat source-side unit 2 is installed outside the air conditioning target space. For example, the heat source-side unit 2 is installed on the rooftop of a building or near a wall of a building.

As illustrated in FIG. 2, the heat source-side unit 2 mainly includes an accumulator 7, the compressor 8, a flow direction switching mechanism 10, a heat source-side heat exchanger 16, a heat source-side expansion mechanism 12, a liquid-side shutoff valve 13, a gas-side shutoff valve 14, and a heat source-side fan 15. It should be noted however that the heat source-side unit 2 does not necessarily include some of the above components. For example, in a case where the air conditioning unit 1 is configured to only cool an air conditioning target space, the heat source-side unit 2 does not necessarily include the flow direction switching mechanism 10. Alternatively, the heat source-side unit 2 may include a component different from the above components as required.

As illustrated in FIG. 2, the heat source-side unit 2 mainly includes, as refrigerant pipes for connecting various constituent elements of the refrigerant circuit 6, a suction pipe 17, a discharge pipe 18, a first gas-refrigerant pipe 19, a liquid-refrigerant pipe 20, and a second gas-refrigerant pipe 21. The suction pipe 17 connects the flow direction switching mechanism 10 and an inlet side of the compressor 8. The suction pipe 17 is provided with the accumulator 7. The discharge pipe 18 connects a discharge side of the compressor 8 and the flow direction switching mechanism 10. The first gas-refrigerant pipe 19 connects the flow direction switching mechanism 10 and a gas side of the heat source-side heat exchanger 16. The liquid-refrigerant pipe 20 connects a liquid-side of the heat source-side heat exchanger 16 and the liquid-side shutoff valve 13. The liquid-refrigerant pipe 20 is provided with the heat source-side expansion mechanism 12. The second gas-refrigerant pipe 21 connects the flow direction switching mechanism 10 and the gas-side shutoff valve 14.

The compressor 8 is configured to suck in the low-pressure refrigerant in the refrigeration cycle, through the suction pipe 17, compress the refrigerant in a compression mechanism (not illustrated), and discharge the compressed refrigerant to the discharge pipe 18.

The flow direction switching mechanism 10 is configured to switch a refrigerant flowing direction, thereby changing a state of the refrigerant circuit 6 between a first state and a second state. In this embodiment, the flow direction switching mechanism 10 is a four-way switching valve, but is not limited to a four-way switching valve. For example, the flow direction switching mechanism 10 may include a plurality of valves and a plurality of pipes. When the refrigerant circuit 6 is in the first state, the heat source-side heat exchanger 16 functions as a radiator (a condenser) for the refrigerant, and a utilization-side heat exchanger 32 functions as an evaporator for the refrigerant. When the refrigerant circuit 6 is in the second state, the heat source-side heat exchanger 16 functions as an evaporator for the refrigerant, and the utilization-side heat exchanger 32 functions as a radiator for the refrigerant. When the flow direction switching mechanism 10 switches the state of the refrigerant circuit 6 to the first state, the flow direction switching mechanism 10 causes the suction pipe 17 to communicate with the second gas-refrigerant pipe 21, and causes the discharge pipe 18 to communicate with the first gas-refrigerant pipe 19 (see a solid line in the flow direction switching mechanism 10 illustrated in FIG. 2). When the flow direction switching mechanism 10 switches the state of the refrigerant circuit 6 to the second state, the flow direction switching mechanism 10 causes the suction pipe 17 to communicate with the first gas-refrigerant pipe 19, and causes the discharge pipe 18 to communicate with the second gas-refrigerant pipe 21 (see a broken line in the flow direction switching mechanism 10 illustrated in FIG. 2).

The heat source-side heat exchanger 16 is configured to cause the refrigerant flowing therethrough to exchange heat with air (heat source air) in the place where the heat source-side unit 2 is installed. The heat source-side heat exchanger 16 may be of any type. For example, the heat source-side heat exchanger 16 may be a fin-and-tube heat exchanger that includes a plurality of heat transfer tubes and a plurality of fins (not illustrated). The heat source-side heat exchanger 16 has a first end connected to the first gas-refrigerant pipe 19. The heat source-side heat exchanger 16 has a second end connected to the liquid-refrigerant pipe 20.

The heat source-side expansion mechanism 12 is disposed between the heat source-side heat exchanger 16 and the utilization-side heat exchanger 32 in the refrigerant circuit 6. The heat source-side expansion mechanism 12 is disposed on the liquid-refrigerant pipe 20 between the heat source-side heat exchanger 16 and the liquid-side shutoff valve 13. The heat source-side expansion mechanism 12 is configured to adjust a pressure and a flow rate of the refrigerant flowing through the liquid-refrigerant pipe 20. In this embodiment, the heat source-side expansion mechanism 12 is an opening degree-changeable electronic expansion valve. The heat source-side expansion mechanism 12 may alternatively be a feeler bulb-type expansion valve or a capillary tube.

The accumulator 7 has a gas-liquid separating function of separating the refrigerant, which flows thereinto, into the gas refrigerant and the liquid refrigerant. The accumulator 7 also has storing function of storing a surplus of the refrigerant in accordance with, for example, a variation in operation load.

The liquid-side shutoff valve 13 is disposed on a joint between the liquid-refrigerant pipe 20 and the liquid-refrigerant connection pipe 4. The gas-side shutoff valve 14 is disposed on a joint between the second gas-refrigerant pipe 21 and the gas-refrigerant connection pipe 5. The liquid-side shutoff valve 13 and the gas-side shutoff valve 14 are open during the operation of the air conditioning unit 1.

The heat source-side fan 15 is configured to take heat source air from the outside in a casing (not illustrated) of the heat source-side unit 2, supply the heat source air to the heat source-side heat exchanger 16, and discharge the air subjected to heat exchange with the refrigerant in the heat source-side heat exchanger 16, out of the casing of the heat source-side unit 2. The heat source-side fan 15 is, for example, a propeller fan. The heat source-side fan 15 is not limited to a propeller fan, and a fan of any type may be appropriately selected as the heat source-side fan 15.

(2-2-2) Utilization-Side Unit

With reference to FIG. 2, a description will be given of an exemplary configuration of the utilization-side unit 3.

The utilization-side unit 3 is installed in, for example, the air conditioning target space. For example, the utilization-side unit 3 is designed to be embedded in a ceiling. The utilization-side unit 3 may alternatively be designed to be suspended from a ceiling, hung on a wall, or placed on a floor. Alternatively, the utilization-side unit 3 may be installed outside the air conditioning target space. For example, the utilization-side unit 3 may be installed in an attic, a machine chamber, or the like. In this case, an air passage is provided for supplying air subjected to heat exchange with the refrigerant in the utilization-side heat exchanger 32, from the utilization-side unit 3 to the air conditioning target space. The air passage is, for example, a duct. The air passage is not limited to a duct, and an air passage of any type may be appropriately selected.

As illustrated in FIG. 2, the utilization-side unit 3 mainly includes a utilization-side expansion mechanism 31, the utilization-side heat exchanger 32, and the utilization-side fan 33.

The utilization-side expansion mechanism 31 is disposed between the heat source-side heat exchanger 16 and the utilization-side heat exchanger 32 in the refrigerant circuit 6. The utilization-side expansion mechanism 31 is disposed on a refrigerant pipe connecting the utilization-side heat exchanger 32 and the liquid-refrigerant connection pipe 4. The utilization-side expansion mechanism 31 is configured to adjust a pressure and a flow rate of the refrigerant flowing through the refrigerant pipe. In this embodiment, the utilization-side expansion mechanism 31 is, but not limited to, an opening degree-changeable electronic expansion valve.

The utilization-side heat exchanger 32 causes the refrigerant flowing therethrough to exchange heat with the air in the air conditioning target space. The utilization-side heat exchanger 32 may be of any type. For example, the utilization-side heat exchanger 32 may be a fin-and-tube heat exchanger that includes a plurality of heat transfer tubes and a plurality of fins (not illustrated). The utilization-side heat exchanger 32 has a first end connected to the liquid-refrigerant connection pipe 4 via a refrigerant pipe. The utilization-side heat exchanger 32 has a second end connected to the gas-refrigerant connection pipe 5 via a refrigerant pipe.

The utilization-side fan 33 is configured to suck air in the air conditioning target space into a casing (not illustrated) of the utilization-side unit 3, supply the air to the utilization-side heat exchanger 32, and blow out the air subjected to heat exchange with the refrigerant in the utilization-side heat exchanger 32 toward the air conditioning target space. The utilization-side fan 33 is, for example, a turbo fan. The utilization-side fan 33 is not limited to a turbo fan, and a fan of any type may be appropriately selected as the utilization-side fan (2-2-3) Liquid-Refrigerant Connection Pipe, Gas-Refrigerant Connection Pipe The liquid-refrigerant connection pipe 4 and the gas-refrigerant connection pipe 5 connect the heat source-side unit 2 to the utilization-side unit 3. The liquid-refrigerant connection pipe 4 is provided with the liquid-side shutoff valve 54 of the shutoff valve device 50. The gas-refrigerant connection pipe 5 is provided with the gas-side shutoff valve 56 of the shutoff valve device 50.

For example, each of the liquid-side shutoff valve 54 and the gas-side shutoff valve 56 is, but not limited to, an electromagnetic valve or an electric valve. The liquid-side shutoff valve 54 is closed to prevent the refrigerant from flowing from the heat source-side unit 2 into the utilization-side unit 3 through the liquid-refrigerant connection pipe 4. The gas-side shutoff valve 56 is closed to prevent the refrigerant from flowing from the heat source-side unit 2 into the utilization-side unit 3 through the gas-refrigerant connection pipe 5.

(2-2-4) Heat Source-Side Control Device

The heat source-side control device 42 mainly includes a microcontroller unit (MCU), various electric circuits, and various electronic circuits, for controlling the respective components of the heat source-side unit 2. The MCU includes a central processing unit (CPU), a memory, an input/output (I/O) interface, and the like. The memory of the MCU stores various programs which the CPU of the MCU executes. Various functions (to be described later) of the heat source-side control device 42 may be implemented by hardware, software, or a combination of hardware and software.

As illustrated in FIG. 2, the heat source-side control device 42 is electrically connected to the respective components of the heat source-side unit 2, such as the compressor 8, the flow direction switching mechanism 10, the heat source-side expansion mechanism 12, and the heat source-side fan 15. The heat source-side control device 42 is also electrically connected to a sensor (not illustrated) of the heat source-side unit 2. Examples of the sensor may include, but not limited to, a temperature sensor and a pressure sensor disposed on the discharge pipe 18, a temperature sensor and a pressure sensor disposed on the suction pipe 17, a temperature sensor disposed on the heat source-side heat exchanger 16, a temperature sensor disposed on the liquid-refrigerant pipe 20, and a temperature sensor for measuring a temperature of heat source air.

The heat source-side control device 42 is also connected to the utilization-side control device 44*a* via the communication line 46. The heat source-side control device 42 exchanges a control signal for the air conditioning unit 1 with the utilization-side control device 44*a* via the communication line 46. The control signal for the air conditioning unit 1 is used for controlling the respective devices of the air conditioning unit 1.

As illustrated in FIG. 1, the heat source-side control device 42 includes a heat source-side air conditioning control unit 42*a* as a functional unit for controlling the respective components of the heat source-side unit 2. The heat source-side air conditioning control unit 42*a* functions as an air conditioning control unit for controlling the operation of the air conditioning unit 1, in conjunction with a utilization-side air conditioning control unit 44*a*1 of the utilization-side control device 44*a* and a control device 48*a* (to be described later) of the remote controller 48. The air conditioning control unit controls the operations of the respective devices of the air conditioning unit 1, based on a command input to the remote controller 48, measurement values of the respective sensors of the heat source-side unit 2 and utilization-side unit 3, and the like.

During a cooling operation, for example, the air conditioning control unit controls the operation of the flow direction switching mechanism 10 such that the flow direction switching mechanism 10 switches the state of the refrigerant circuit 6 to the first state in which the heat source-side heat exchanger 16 functions as a radiator for the refrigerant and the utilization-side heat exchanger 32 functions as an evaporator for the refrigerant. During the cooling operation, the air conditioning control unit operates the compressor 8, the heat source-side fan 15, and the utilization-side fan 33. During the cooling operation, the air conditioning control unit adjusts the number of rotations of a motor in each of the compressor 8, the heat source-side fan 15, and the utilization-side fan 33, based on measurement values of the respective sensors, a set temperature, and the like. The air conditioning control unit also adjusts an opening degree of an electronic expansion valve, such as the heat source-side expansion mechanism 12 or the utilization-side expansion mechanism 31, to a predetermined opening degree, based on measurement values of the respective sensors, a set temperature, and the like. During a heating operation, for example, the air conditioning control unit controls the operation of the flow direction switching mechanism 10 such that the flow direction switching mechanism 10 switches the state of the refrigerant circuit 6 to the second state in which the heat source-side heat exchanger 16 functions as an evaporator for the refrigerant and the utilization-side heat exchanger 32 functions as a radiator for the refrigerant. During the heating operation, the air conditioning control unit operates the compressor 8, the heat source-side fan 15, and the utilization-side fan 33. During the heating operation, the air conditioning control unit adjusts the number of rotations of the motor in each of the compressor 8, the heat source-side fan 15, and the utilization-side fan 33, based on measurement values of the respective sensors, a set temperature, and the like. The air conditioning control unit also adjusts the opening degree of the electronic expansion valve, such as the heat source-side expansion mechanism 12 or the utilization-side expansion mechanism 31, to a predetermined opening degree, based on measurement values of the respective sensors, a set temperature, and the like.

As to a specific method for controlling the operations of the respective devices of the air conditioning unit 1 during the cooling operation and the heating operation, various control methods have already been known; therefore, the description thereof will not be given here, for the sake of simplification of the description.

The heat source-side air conditioning control unit 42*a* receives an operation prohibition signal from the utilization-side control device 44*a* via the communication line 46. In response to this operation prohibition signal, the heat source-side air conditioning control unit 42*a* performs operation prohibition control on the respective components of the heat source-side unit 2. The operation prohibition signal will be described later. The heat source-side air conditioning control unit 42*a* performs the operation prohibition control for at least prohibiting the operation of the compressor 8. The heat source-side air conditioning control unit 42*a* may perform the operation prohibition control for prohibiting the operation of the heat source-side fan 15 in addition to the operation of the compressor 8. In this embodiment, the heat source-side air conditioning control unit 42*a* performs the operation prohibition control to prohibit the operation of the compressor 8 and the operation of the heat source-side fan 15.

Specifically, the heat source-side air conditioning control unit 42*a* performs the operation prohibition control to prohibit startup of each of the compressor 8 and the heat source-side fan 15 in the heat source-side unit 2 that is at a standstill. The heat source-side air conditioning control unit 42*a* may perform the operation prohibition control to stop each of the compressor 8 and the heat source-side fan 15 in the heat source-side unit 2 during operation. When stopping each of the compressor 8 and the heat source-side fan 15 in the heat source-side unit 2 during operation in the operation prohibition control, the heat source-side air conditioning control unit 42*a* may stop the compressor 8 and the heat source-side fan 15 in a manner similar to that in stopping a normal air conditioning operation. When stopping each of the compressor 8 and the heat source-side fan 15 in the heat source-side unit 2 during operation in the operation prohibition control, the heat source-side air conditioning control unit 42*a* may alternatively stop the compressor 8 and the heat source-side fan 15 in a manner different from that in stopping the normal air conditioning operation.

The heat source-side air conditioning control unit 42*a* receives a leakage detection signal from the utilization-side control device 44*a* via the communication line 46. In response to this leakage detection signal, the heat source-side air conditioning control unit 42*a* performs leakage control on the respective components of the heat source-side unit 2. The leakage detection signal will be described later. The heat source-side air conditioning control unit 42*a* performs the leakage control to prohibit startup of each of the compressor 8 and the heat source-side fan 15 in the heat source-side unit 2 that is at a standstill. In addition, the heat source-side air conditioning control unit 42*a* performs the leakage control to stop each of the compressor 8 and the heat source-side fan 15 in the heat source-side unit 2 during operation. When stopping each of the compressor 8 and the heat source-side fan 15 in the heat source-side unit 2 during operation in the leakage control, the heat source-side air conditioning control unit 42*a* may stop the compressor 8 and the heat source-side fan 15 in a manner similar to that in stopping the normal air conditioning operation or in a manner similar to that in the operation prohibition control. Alternatively, the heat source-side air conditioning control unit 42*a* may stop the compressor 8 and the heat source-side fan 15 in a manner different from that in stopping the normal air conditioning operation and that in the operation prohibition control.

(2-2-5) Utilization-Side Control Device

The utilization-side control device 44*a* includes an micro controller unit (MCU), various electric circuits, and various electronic circuits. The MCU includes a CPU, a memory, an I/O interface, and the like. The memory of the MCU stores various programs which the CPU of the MCU executes. Various functions (to be described later) of the utilization-side control device 44*a* may be implemented by hardware, software, or a combination of hardware and software. Some of the functions (to be described later) of the utilization-side control device 44*a* may be implemented by a control device different from the utilization-side control device 44*a*.

As illustrated in FIG. 2, the utilization-side control device 44*a* is electrically connected to various components of the utilization-side unit 3, such as the utilization-side expansion mechanism 31 and the utilization-side fan 33. The utilization-side control device 44*a* is also electrically connected to a sensor (not illustrated) of the utilization-side unit 3. Examples of the sensor may include, but not limited to, a temperature sensor on the utilization-side heat exchanger 32, a temperature sensor on the liquid-side refrigerant pipe connected to the utilization-side heat exchanger 32, and a temperature sensor for measuring a temperature in the air conditioning target space.

The utilization-side control device 44*a* is connected to the heat source-side control device 42 via the communication line 46 as described above. In addition, the utilization-side control device 44*a* is connected to the remote controller 48 via the communication line 46 such that the utilization-side control device 44*a* is capable of communicating with the remote controller 48.

As illustrated in FIG. 1, the utilization-side control device 44*a* includes, as functional units, a utilization-side air conditioning control unit 44*a*1, a first disconnection detection unit 44*a*2, a second disconnection detection unit 44*a*3, and a leakage determination unit 44*a*4. Next, a specific description will be given of each of the functional units.

(2-2-5-1) Utilization-Side Air Conditioning Control Unit

The utilization-side air conditioning control unit 44*a*1 is configured to control the respective components of the utilization-side unit 3. The utilization-side air conditioning control unit 44*a*1 functions as the air conditioning control unit for controlling the air conditioning unit 1 in conjunction with the heat source-side air conditioning control unit 42*a* and the remote controller 48. The air conditioning control unit is not described below since the description thereof has been given above.

The utilization-side air conditioning control unit 44*a*1 prohibits the operation of the utilization-side unit 3 in a case where the first disconnection detection unit 44*a*2 detects that the utilization-side unit 3 is not connected to any of the safety devices via the corresponding first electric wire 92. In the following, the time when the first disconnection detection unit 44*a*2 detects that the utilization-side unit 3 is not connected to any of the safety devices via the corresponding first electric wire 92 is occasionally referred to as "upon disconnection of the first electric wire", for the sake of simplification of the description.

The utilization-side air conditioning control unit 44*a*1 also prohibits the operation of the utilization-side unit 3 in a case where the second disconnection detection unit 44*a*3 detects that the utilization-side unit 3 is not connected to the refrigerant sensor 34 via the signal line 96. In the following, the time when the second disconnection detection unit 44*a*3 detects that the utilization-side unit 3 is not connected to the refrigerant sensor 34 via the signal line 96 is occasionally referred to as "upon disconnection of the signal line", for the sake of simplification of the description.

In other words, upon disconnection of the first electric wire and disconnection of the signal line, the utilization-side air conditioning control unit 44*a*1 performs the operation prohibition control on each component of the utilization-side unit 3. The utilization-side air conditioning control unit 44*a*1 performs the operation prohibition control to prohibit startup of the utilization-side fan 33 in the utilization-side unit 3 that is at a standstill. The utilization-side air conditioning control unit 44*a*1 may perform the operation prohibition control to stop the utilization-side fan 33 in the utilization-side unit 3 during operation in place of or in addition to the prohibition of startup of the utilization-side fan 33 in the utilization-side unit 3 that is at a standstill. In stopping the utilization-side fan 33 in the utilization-side unit 3 during operation by the operation prohibition control, the utilization-side air conditioning control unit 44*a*1 may stop the utilization-side fan 33 in a manner similar to that in stopping the normal air conditioning operation or may stop the utilization-side fan 33 in a manner different from that in stopping the normal air conditioning operation.

In addition, the utilization-side air conditioning control unit 44*a*1 performs leakage control on each component of the utilization-side unit 3 in a case where the leakage determination unit 44*a*4 determines that the refrigerant leaks. The utilization-side air conditioning control unit 44*a*1 performs the leakage control to prohibit startup of the utilization-side fan 33 in the utilization-side unit 3 that is at a standstill. In addition, the utilization-side air conditioning control unit 44*a*1 performs the leakage control to prohibit startup of the utilization-side fan 33 in the utilization-side unit 3 during operation. In stopping the utilization-side fan 33 during operation by the leakage control, the utilization-side air conditioning control unit 44*a*1 may stop the utilization-side fan 33 in a manner similar to that in stopping the normal air conditioning operation or in a manner similar to that in the operation prohibition control. Alternatively, the utilization-side air conditioning control unit 44*a*1 may stop the utilization-side fan 33 in a manner different from that in stopping the normal air conditioning operation and that in the operation prohibition control.

(2-2-5-2) First Disconnection Detection Unit

The first disconnection detection unit 44*a*2 detects whether the utilization-side unit 3 is connected to the safety device via the corresponding first electric wire 92. In a case where the utilization-side unit 3 is not connected to one of the alarm 70, the ventilation device 60, and the shutoff valve device 50 via the corresponding first electric wire 92, the first disconnection detection unit 44*a*2 detects disconnection of the first electric wire 92 between the utilization-side unit 3 and the safety device.

A specific description will be given below.

The alarm 70 includes the interlock circuit 72*b*. The ventilation device 60 includes the interlock circuit 62*b*. The shutoff valve device 50 includes the interlock circuit 52*b*. In a case where the interlock circuit 44*c* of the utilization-side unit 3 is connected to the interlock circuit 72*b* of the alarm 70 via the corresponding first electric wire 92 and the first electric wire 92 has no break, the interlock circuit 44*c*, the interlock circuit 72*b*, and the first electric wire 92 constitute an electric circuit through which a predetermined electric current flows. Upon detection of a state in which no electric current flows through this electric circuit, the first disconnection detection unit 44*a*2 detects that the utilization-side unit 3 is not connected to the alarm 70 via the first electric wire 92. A relay, an ammeter, a break detector, or the like may be used for detection of such disconnection. The first disconnection detection unit 44*a*2 detects that the utilization-side unit 3 is not connected to the ventilation device 60 via the corresponding first electric wire 92 and detects that the utilization-side unit 3 is not connected to the shutoff valve device 50 via the corresponding first electric wire 92 in a manner similar to the manner upon detection of the disconnection of the first electric wire 92 between the utilization-side unit 3 and the alarm 70; therefore, the description thereof will not be given here.

The utilization-side air conditioning control unit 44*a*1 prohibits the operation of the utilization-side unit 3 in a case where the first disconnection detection unit 44*a*2 detects that the utilization-side unit 3 is not connected to any of the safety devices via the corresponding first electric wire 92. In other words, the utilization-side air conditioning control unit 44*a*1 performs the operation prohibition control on the utilization-side unit 3 upon disconnection of the first electric wire.

In addition, the utilization-side control device 44*a* transmits an operation prohibition signal to the heat source-side unit 2 via the communication line 46 in a case where the first disconnection detection unit 44*a*2 detects that the utilization-side unit 3 is not connected to any of the safety devices via the corresponding first electric wire 92.

(2-2-5-3) Second Disconnection Detection Unit

The second disconnection detection unit 44*a*3 detects whether the utilization-side control device 44*a* of the utilization-side unit 3 is connected to the refrigerant sensor 34 via the signal line 96. Using, for example, a break detector, the second disconnection detection unit 44*a*3 detects whether the utilization-side control device 44*a* is connected to the refrigerant sensor 34 via the signal line 96.

Figure 3:
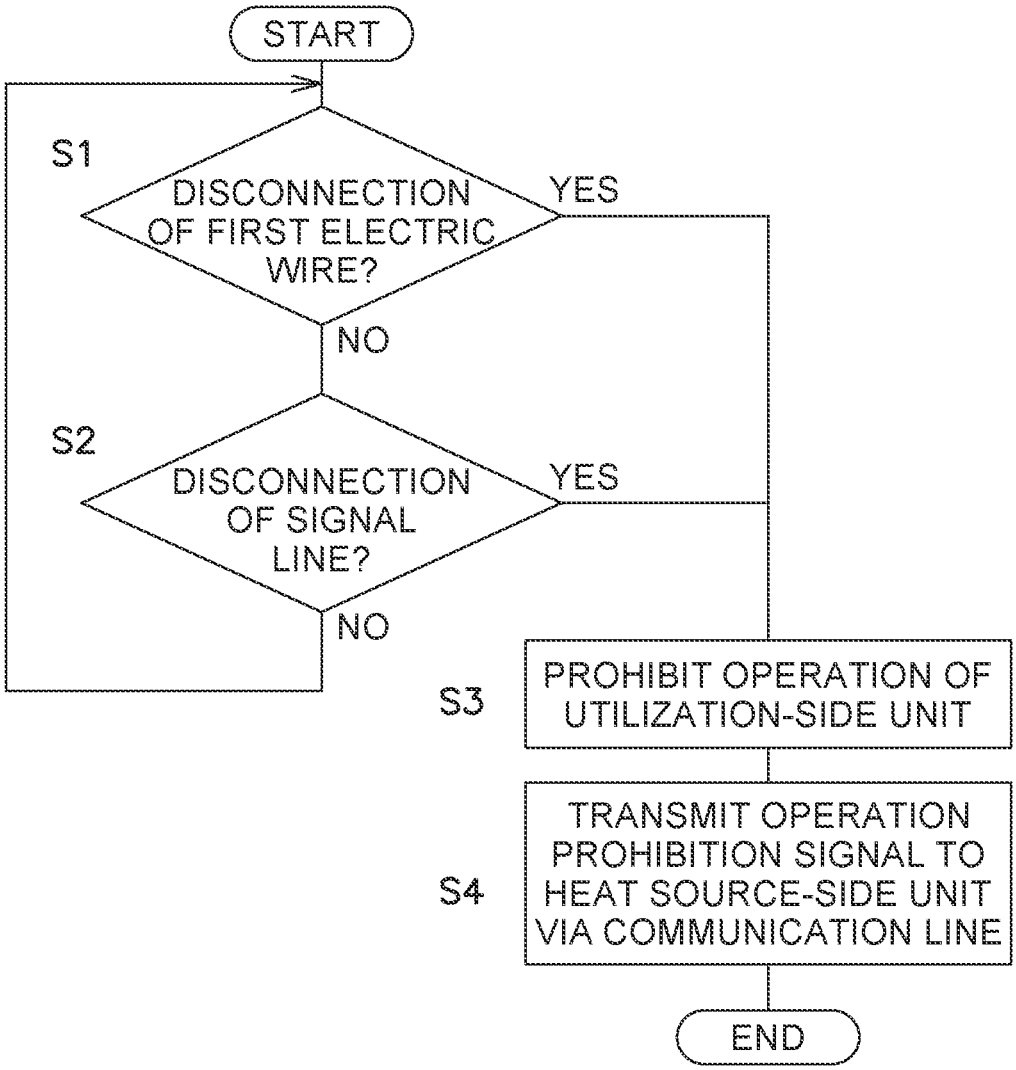
FIG. 3 is a flowchart of interlock in the air conditioning unit of the air conditioning system illustrated in FIG. 1.

With reference to a flowchart of FIG. 3, next, a description will be given of interlock that prohibits the operation of the air conditioning unit 1 upon disconnection of the first electric wire and upon disconnection of the signal line. The flowchart of FIG. 3 is merely an example; therefore, the flowchart may be appropriately changed as long as no contradiction arises.

As a premise, the first disconnection detection unit 44*a*2 detects whether the utilization-side unit 3 is connected to the alarm 70 via the corresponding first electric wire 92, whether the utilization-side unit 3 is connected to the ventilation device 60 via the corresponding first electric wire 92, and whether the utilization-side unit 3 is connected to the shutoff valve device 50 via the corresponding first electric wire 92, at at least predetermined time intervals. The second disconnection detection unit 44*a*3 detects whether the utilization-side control device 44*a* is connected to the refrigerant sensor 34 via the signal line 96, at at least predetermined time intervals.

Preferably, the first disconnection detection unit 44*a*2 successively detects whether the utilization-side unit 3 is connected to the alarm 70 via the corresponding first electric wire 92, whether the utilization-side unit 3 is connected to the ventilation device 60 via the corresponding first electric wire 92, and whether the utilization-side unit 3 is connected to the shutoff valve device 50 via the corresponding first electric wire 92. Preferably, the second disconnection detection unit 44*a*3 successively detects whether the utilization-side control device 44*a* is connected to the refrigerant sensor 34 via the signal line 96.

When the first disconnection detection unit 44*a*2 detects that the utilization-side unit 3 is not connected to one of the alarm 70, the ventilation device 60, and the shutoff valve device 50 via the corresponding first electric wire 92 (YES in step S1), the processing proceeds to step S3. On the other hand, when the first disconnection detection unit 44*a*2 does not detect disconnection of the first electric wire 92 between the utilization-side unit 3 and the alarm 70, disconnection of the first electric wire 92 between the utilization-side unit 3 and the ventilation device 60, and disconnection of the first electric wire 92 between the utilization-side unit 3 and the shutoff valve device 50, the processing proceeds to step S2.

In step S2, when the second disconnection detection unit 44*a*3 detects disconnection of the signal line 96 between the utilization-side control device 44*a* and the refrigerant sensor 34 (YES in step S2), the processing proceeds to step S3. On the other hand, when the second disconnection detection unit 44*a*3 does not detect disconnection of the signal line 96 between the utilization-side control device 44*a* and the refrigerant sensor 34, the processing returns to step S1. Steps S1 and S2 are carried out repeatedly until disconnection is detected in one of steps S1 and S2.

In step S3, the utilization-side air conditioning control unit 44a1 prohibits the operation of the utilization-side unit 3. In other words, the utilization-side air conditioning control unit 44a1 performs the operation prohibition control on the utilization-side unit 3.

In step S4, the utilization-side control device 44a transmits an operation prohibition signal to the heat source-side unit 2 via the communication line 46. In other words, the utilization-side control device 44a sends an instruction to perform the operation prohibition control to the heat source-side unit 2 via the communication line 46 upon disconnection of the first electric wire and upon disconnection of the signal line.

(2-2-5-4) Leakage Determination Unit

The leakage determination unit 44a4 is configured to determine occurrence of a refrigerant leak, based on a detection signal which the refrigerant sensor 34 outputs. For example, it is assumed herein that the refrigerant sensor 34 is a semiconductor-type refrigerant sensor. Using a characteristic of the refrigerant sensor 34 that outputs a relatively large electric current if a refrigerant gas is present around a sensor element, the leakage determination unit 44a4 determines that the refrigerant leaks, when an electric current which the refrigerant sensor 34 outputs exceeds a predetermined value.

In the following, "the time when the leakage determination unit 44a4 determines that the refrigerant leaks based on the detection signal which the refrigerant sensor 34 outputs" is simply referred to as "upon detection of a refrigerant leak". Alternatively, "the time when the leakage determination unit 44a4 determines that the refrigerant leaks based on the detection signal which the refrigerant sensor 34 outputs" is simply referred to as "upon detection of a refrigerant leak by the refrigerant sensor 34".

With reference to a flowchart of FIG. 4, a description will be given of refrigerant leak control to be performed by the air conditioning system 100 in a case where the leakage determination unit 44a4 determines that the refrigerant leaks. The flowchart of FIG. 4 is merely an example; therefore, the flowchart may be appropriately changed as long as no contradiction arises.

Figure 4:
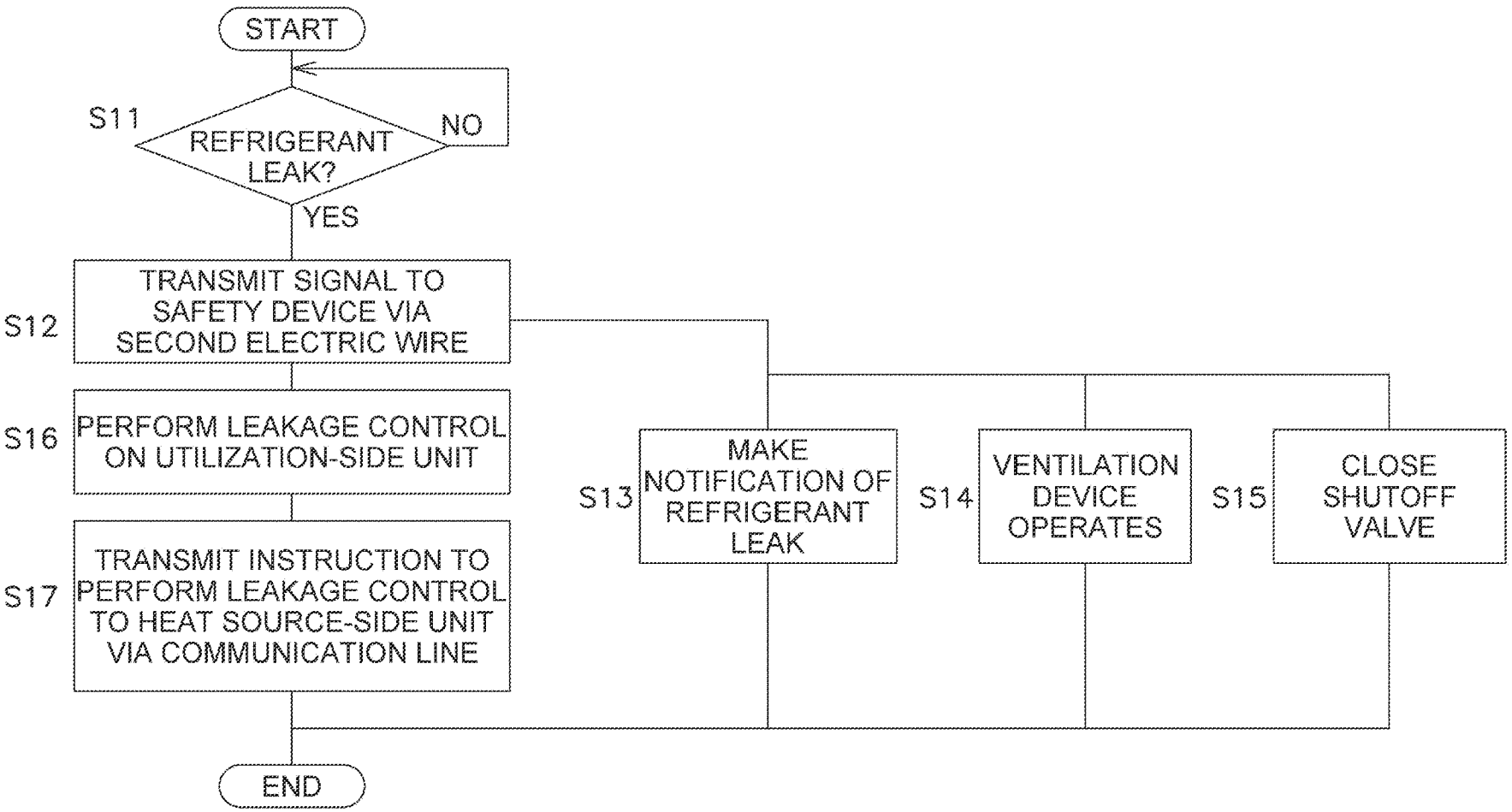
FIG. 4 is a flowchart of control upon leakage of a refrigerant in the air conditioning system illustrated in FIG. 1.

With reference to FIG. 4, in step S11, when the leakage determination unit 44a4 determines that the refrigerant leaks (YES in step S11), the processing proceeds to step S12. In step S12, the safety device drive circuit 44b transmits a signal to the safety device via the corresponding second electric wire 94 such that the safety device performs an operation upon detection of a refrigerant leak. A determination by the leakage determination unit 44a4 in step S11 is made repeatedly until the leakage determination unit 44a4 determines that the refrigerant leaks.

In response to the signal from the safety device drive circuit 44b, the safety device performs the operation upon detection of a refrigerant leak detection. Specifically, the alarm 70 makes a notification of the refrigerant leak in step S13. The ventilation device 60 starts to operate in step S14. The shutoff valve device 50 closes the liquid-side shutoff valve 54 and the gas-side shutoff valve 56 in step S15.

In step S16, the utilization-side air conditioning control unit 44a1 prohibits the operation of the utilization-side unit 3. In other words, the utilization-side air conditioning control unit 44a1 performs leakage control on the utilization-side unit 3 in a case where the leakage determination unit 44a4 determines that the refrigerant leaks.

In step S17, the utilization-side control device 44a transmits a leakage detection signal to the heat source-side unit 2 via the communication line 46. In other words, the utilization-side control device 44a sends an instruction to perform the leakage control to the heat source-side unit 2 via the communication line 46 in a case where the leakage determination unit 44a4 determines that the refrigerant leaks.

(2-2-6) Remote Controller

The remote controller 48 is configured to operate the air conditioning unit 1. For example, the remote controller 48 is hung on a wall that defines the air conditioning target space; however, the remote controller 48 may be attached to any place. The remote controller 48 is connected to the utilization-side control device 44a via the communication line 46 such that the remote controller 48 is capable of communicating with the utilization-side control device 44a.

The remote controller 48 includes the control device 48a that includes an MCU, various electric circuits, and various electronic circuits. The control device 48a functions as an air conditioning control unit for controlling the operation of the air conditioning unit 1, in conjunction with the heat source-side air conditioning control unit 42a and the utilization-side air conditioning control unit 44a1. The MCU includes a CPU, a memory, an I/O interface, and the like. The memory of the MCU stores various programs which the CPU of the MCU executes. Various functions (to be described later) of the remote controller 48 may be implemented by hardware, software, or a combination of hardware and software.

The remote controller 48 also includes an operation unit 48b and a display unit 48c.

The operation unit 48b is a functional unit through which a user inputs various commands to the air conditioning unit 1. The operation unit 48b includes various switches and a touch screen.

The display unit 48c displays settings on the air conditioning unit 1 and a status of the air conditioning unit 1. The display unit 48c displays, as a status of the air conditioning unit 1, prohibition of the operation of the heat source-side unit 2, as a result of detection of disconnection of the first electric wire 92 by the first disconnection detection unit 44a2 or detection of disconnection of the signal line 96 by the second disconnection detection unit 44a3. The display unit 48c is an example of a notification unit configured to make a notification that the heat source-side unit 2 is prohibited from operation. The display unit 48c may further display prohibition of the operation of the utilization-side unit 3, as a result of detection of disconnection of the first electric wire 92 by the first disconnection detection unit 44a2 or detection of disconnection of the signal line 96 by the second disconnection detection unit 44a3.

(2-3) Refrigerant Sensor

The refrigerant sensor 34 is configured to detect whether the refrigerant flows near the refrigerant sensor 34. The refrigerant sensor 34 is disposed together with the utilization-side expansion mechanism 31, the utilization-side heat exchanger 32, the utilization-side fan 33, and the like in a casing (not illustrated) of the utilization-side unit 3. The refrigerant sensor 34 may alternatively be disposed outside the casing of the utilization-side unit 3.

The refrigerant sensor 34 is, for example, a semiconductor sensor. The semiconductor refrigerant sensor 34 includes a semiconductor detection element (not illustrated). The electric conductivity of the semiconductor detection element changes depending on whether the refrigerant gas is present nearby. Using this characteristic, the refrigerant sensor 34 outputs a relatively large electric current in a case where the refrigerant is present near the semiconductor detection element.

The refrigerant sensor 34 is not limited to a semiconductor sensor as long as it is capable of detecting a refrigerant gas. For example, the refrigerant sensor 34 may be an infrared sensor.

(2-4) Alarm

The alarm 70 is configured to make a notification of a refrigerant leak upon detection of the refrigerant leak by the refrigerant sensor 34. Specifically, the alarm 70 makes a notification of a refrigerant leak in accordance with a signal which the safety device drive circuit 44*b* transmits to the alarm 70 via the corresponding second electric wire 94.

The alarm 70 includes the control device 72*a*, the interlock circuit 72*b*, a lamp 74 for notifying a user of a refrigerant leak, and a speaker 76 for notifying a user of a refrigerant leak.

The control device 72*a* is configured to control operations of the lamp 74 and speaker 76. Various functions of the control device 72*a* may be implemented by hardware, software, or a combination of hardware and software. Upon reception of a signal from the safety device drive circuit 44*b* via the corresponding second electric wire 94, the control device 72*a* turns on the lamp 74 and outputs a warning from the speaker 76.

The interlock circuit 72*b* constitutes an electric circuit in conjunction with the interlock circuit 44*c* and the first electric wire 92. The first disconnection detection unit 44*a*2 detects disconnection of the first electric wire 92 between the alarm 70 and the utilization-side unit 3, based on whether an electric current flows through the electric circuit.

(2-5) Ventilation Device

The ventilation device 60 mainly includes the control device 62*a*, the interlock circuit 62*b*, and the ventilation fan 64. The control device 62*a* is configured to control the operation of the ventilation fan 64. Various functions of the control device 62*a* may be implemented by hardware, software, or a combination of hardware and software.

The ventilation fan 64 is configured to discharge air in a space where the refrigerant possibly leaks, out of the space. For example, the ventilation fan 64 discharges air in the space where the utilization-side unit 3 including the refrigerant sensor 34 is installed, out of the space.

The ventilation device 60 is configured to operate upon detection of a refrigerant leak by the refrigerant sensor 34. Specifically, the control device 62*a* starts the operation of the ventilation fan 64 in response to a signal for startup of the ventilation fan 64 sent from the safety device drive circuit 44*b* via the corresponding second electric wire 94.

The interlock circuit 62*b* constitutes an electric circuit in conjunction with the interlock circuit 44*c* and the first electric wire 92. The first disconnection detection unit 44*a*2 detects disconnection of the first electric wire 92 between the utilization-side unit 3 and the ventilation device 60, based on whether an electric current flows through the electric circuit.

(2-6) Shutoff Valve Device

The shutoff valve device 50 includes the control device 52*a*, the interlock circuit 52*b*, the liquid-side shutoff valve 54 on the liquid-refrigerant connection pipe 4, and the gas-side shutoff valve 56 on the gas-refrigerant connection pipe 5. For example, each of the liquid-side shutoff valve 54 and the gas-side shutoff valve 56 is, but not limited to, an electromagnetic valve or an electric valve. The control device 52*a* controls operations of the liquid-side shutoff valve 54 and gas-side shutoff valve 56. Various functions of the control device 52*a* may be implemented by hardware, software, or a combination of hardware with software.

In a normal state, the liquid-side shutoff valve 54 and the gas-side shutoff valve 56 are open. The shutoff valve device 50 closes the liquid-side shutoff valve 54 and the gas-side shutoff valve 56 upon detection of a refrigerant leak by the refrigerant sensor 34. Specifically, upon reception of a signal, which is for closing the liquid-side shutoff valve 54 and the gas-side shutoff valve 56, from the safety device drive circuit 44*b* via the corresponding second electric wire 94, the control device 52*a* closes the liquid-side shutoff valve 54 and the gas-side shutoff valve 56 in accordance with the received signal.

The interlock circuit 52*b* constitutes an electric circuit in conjunction with the interlock circuit 44*c* and the first electric wire 92. The first disconnection detection unit 44*a*2 detects disconnection of the first electric wire 92 between the shutoff valve device 50 and the utilization-side unit 3, based on whether an electric current flows through the electric circuit.

(3) Features (3-1)

The air conditioning system 100 according to this embodiment is an example of a refrigeration cycle system and includes the air conditioning unit 1, the communication line 46, the refrigerant sensor 34, the safety device, and the first electric wire 92. The air conditioning unit 1 is an example of a refrigeration cycle system. The air conditioning unit 1 includes the utilization-side unit 3 and the heat source-side unit 2 connected to the utilization-side unit 3 via the liquid-refrigerant connection pipe 4 and the gas-refrigerant connection pipe 5. The communication line 46 is used for control signal communication in the air conditioning unit 1. The refrigerant sensor 34 is connected to the utilization-side unit 3 so as to communicate with the utilization-side unit 3 and is configured to detect a refrigerant leak. The safety device includes at least one of the alarm 70, the ventilation device 60, or the shutoff valve device 50. The alarm 70 is configured to make a notification of a refrigerant leak upon detection of the refrigerant leak by the refrigerant sensor 34. The ventilation device 60 is configured to operate upon detection of a refrigerant leak by the refrigerant sensor 34. The shutoff valve device 50 is configured to close the liquid-side shutoff valve 54 on the liquid-refrigerant connection pipe 4 and the gas-side shutoff valve 56 on the gas-refrigerant connection pipe 5 upon detection of a refrigerant leak by the refrigerant sensor 34. The first electric wire 92 connects between the utilization-side unit 3 and the safety device. The first electric wire 92 is an electric wire dedicated for interlock and different from the communication line 46. In the air conditioning system 100, the utilization-side unit 3 and the heat source-side unit 2 are prohibited from operation in a case where the utilization-side unit 3 is not connected to the safety device via the first electric wire 92.

The air conditioning system 100 according to this embodiment includes the first electric wire 92 dedicated for interlock, in addition to the communication line 46 for control signal communication in the air conditioning unit 1. The air conditioning system 100 therefore achieves high reliability regarding a safeguard against a refrigerant leak, without adversely affecting control signal communication in the air conditioning unit 1.

In this embodiment, the prohibition of the air conditioning operation is not determined based on a result of communication between the utilization-side unit 3 and the safety device, but the air conditioning operation is prohibited in a case where the first electric wire 92 between the utilization-side unit 3 and the safety device is broken or in a case where the first electric wire 92 is not provided between the utilization-side unit 3 and the safety device. The air conditioning system 100 therefore achieves high reliability regarding a safeguard against a refrigerant leak, with a relatively simple structure.

(3-2)

In the air conditioning system 100 according to this embodiment, preferably, the utilization-side unit 3 and the heat source-side unit 2 that are at standstills are prohibited from operation in a case where the utilization-side unit 3 is not connected to the safety device via the first electric wire 92.

In the air conditioning system 100 according to this embodiment, preferably, the utilization-side unit 3 and the heat source-side unit 2 during operation are prohibited from operation in a case where the utilization-side unit 3 is not connected to the safety device via the first electric wire 92.

The air conditioning system 100 according to this embodiment readily suppresses occurrence of a failure that the safety device does not work in a case where a refrigerant leak is detected during an air conditioning operation. The air conditioning system 100 according to this embodiment therefore achieves high reliability regarding a safeguard against a refrigerant leak.

(3-3)

The air conditioning system 100 according to this embodiment further includes the second electric wire 94 for control of the operation of the safety device. The second electric wire 94 connects between the utilization-side unit 3 and the safety device. The second electric wire 94 is different from the communication line 46 and the first electric wire 92.

In the air conditioning system 100 according to this embodiment, the communication line 46 for controlling the air conditioning unit 1 is not used for controlling the operation of the safety device, but the second electric wire 94 different from the communication line 46 is used for controlling the operation of the safety device. The air conditioning system 100 therefore achieves high safety without adversely affecting communication for controlling the air conditioning unit 1.

(3-4)

The air conditioning system 100 according to this embodiment further includes the signal line 96. The signal line 96 connects between the utilization-side unit 3 and the refrigerant sensor 34 to allow communication between the utilization-side unit 3 and the refrigerant sensor 34. In the air conditioning system 100, the utilization-side unit 3 and the heat source-side unit 2 are prohibited from operation in a case where the utilization-side unit 3 is not connected to the refrigerant sensor 34 via the signal line 96.

The air conditioning system 100 according to this embodiment suppresses occurrence of a failure that a refrigerant leak is not detected during an air conditioning operation, and therefore achieves high safety.

(3-5)

The air conditioning system 100 according to this embodiment further includes the display unit 48*c* of the remote controller 48, as an example of a notification unit. The display unit 48*c* is configured to make a notification that the heat source-side unit 2 is prohibited from operation. The display unit 48*c* may also be configured to make a notification that the utilization-side unit 3 is prohibited from operation.

In the air conditioning system 100 according to this embodiment, the display unit 48*c* notifies that the operation of the heat source-side unit 2 is prohibited. Users of the refrigeration cycle system is therefore able to promptly implement necessary action, for example, call a maintenance worker.

(4) Modifications (4-1) Modification A

In the foregoing embodiment, the heat source-side unit 2 and the utilization-side unit 3 are prohibited from operation in a case where the utilization-side unit 3 is not connected to the safety device via the first electric wire 92. The heat source-side unit 2 and the utilization-side unit 3 are also prohibited from operation in a case where the utilization-side unit 3 is not connected to the refrigerant sensor 34 via the signal line 96.

However, the configuration of the air conditioning system 100 is not limited thereto. For example, at least the heat source-side unit 2 may be prohibited from operation in one of or both the case where the utilization-side unit 3 is not connected to the safety device via the first electric wire 92 and the case where the utilization-side unit 3 is not connected to the refrigerant sensor 34 via the signal line 96.

For example, in one of or both the case where the utilization-side unit 3 is not connected to the safety device via the first electric wire 92 and the case where the utilization-side unit 3 is not connected to the refrigerant sensor 34 via the signal line 96, the utilization-side fan 33 of the utilization-side unit 3 may be permitted to operate in a state in which the refrigerant does not flow through the refrigerant circuit 6.

(4-2) Modification B

In the foregoing embodiment, the communication line 46 is an electric wire only for control signal communication in the air conditioning unit 1; however, the configuration of the air conditioning system 100 is not limited thereto. For example, the communication line 46 may serve as a second electric wire 94 for control of the operation of the safety device.

(4-3) Modification C

In the foregoing embodiment, the display unit 48*c* of the remote controller 48 functions as a notification unit configured to make a notification that the heat source-side unit 2 is prohibited from operation. However, the configuration of the air conditioning system 100 is not limited thereto.

For example, the air conditioning system 100 may include, as a notification unit, a transmitter configured to provide a notification that at least one of the utilization-side unit 3 or the heat source-side unit 2 is prohibited from operation, to a mobile terminal or the like of an administrator or the like of the air conditioning system 100, via a communication line such as the Internet.

The air conditioning system 100 may alternatively include, as a notification unit, a light emitting diode (LED) lamp disposed on the casing of the utilization-side unit 3 and configured to make a notification that the heat source-side unit 2 is prohibited from operation.

(4-4) Modification D

The alarm 70 may include one of the lamp 74 and the speaker 76 as means for making a notification of a refrigerant leak. The alarm 70 may include another means for making a notification of a refrigerant leak, such as a vibrator, in addition to the lamp 74 and the speaker 76.

Instead of the alarm 70, the remote controller 48 or the utilization-side unit 3 may include the lamp 74 or speaker 76 for making a notification of a refrigerant leak.

(4-5) Modification E

In the foregoing embodiment, the first disconnection detection unit 44*a*2 detects disconnection of the first electric wire 92, based on whether an electric current flows through the electric circuit made up of the interlock circuit 44*c*, the interlock circuit of the safety device, and the first electric wire 92 connecting the interlock circuit 44*c* to the interlock circuit of the safety device. However, the configuration of the air conditioning system 100 is not limited thereto.

For example, the first disconnection detection unit 44*a*2 may detect disconnection of the first electric wire 92, based on whether the safety device transmits a signal via the first electric wire 92 in response to a signal which the utilization-side control device 44*a* transmits to the safety device via the first electric wire 92.

However, disconnection of the first electric wire 92 is detectable with a relatively simple configuration in a case where disconnection of the first electric wire 92 is detected, based on whether an electric current flows through the electric circuit made up of the interlock circuit 44*c*, the interlock circuit of the safety device, and the first electric wire 92 connecting the interlock circuit 44*c* to the interlock circuit of the safety device.

(4-6) Modification F

The second electric wire 94 may be an electric wire for power supply to the safety device. Upon detection of a refrigerant leak by the refrigerant sensor 34, the safety device drive circuit 44*b* may supply electric power to the safety device via the second electric wire 94, thereby allowing the safety device to perform an operation upon detection of a refrigerant leak.

SUPPLEMENTARY NOTE

While various embodiments of the present disclosure have been described herein above, it is to be appreciated that various changes in form and detail may be made without departing from the spirit and scope of the present disclosure presently or hereafter claimed.

The present disclosure is useful as a refrigeration cycle system that is highly reliable as a safeguard against a refrigerant leak.

The invention claimed is:

1. A refrigeration cycle system comprising:

a refrigeration cycle unit including a utilization-side unit, and a heat source-side unit connected to the utilization-side unit via a refrigerant connection pipe;

a communication line configured to be used for control signal communication in the refrigeration cycle unit;

a refrigerant sensor connected to the utilization-side unit so as to communicate with the utilization-side unit, the refrigerant sensor being configured to detect a refrigerant leak;

a safety device including at least one of an alarm configured to make a notification of a refrigerant leak upon detection of the refrigerant leak by the refrigerant sensor, a ventilation device configured to operate upon detection of the refrigerant leak, and a shutoff valve device configured to close a shutoff valve on the refrigerant connection pipe upon detection of the refrigerant leak; and a first electric wire dedicated for interlock, the first electric wire connecting between the utilization-side unit and the safety device, the first electric wire being different from the communication line, the heat source-side unit being prohibited from operation in a case in which the utilization-side unit is not connected to the safety device via the first electric wire.

2. The refrigeration cycle system according to claim 1, wherein the heat source-side unit during operation is prohibited from operation in a case in which the utilization-side unit is not connected to the safety device via the first electric wire.

3. The refrigeration cycle system according to claim 2, further comprising:

a second electric wire for control of an operation of the safety device, the second electric wire connecting between the utilization-side unit and the safety device, and the second electric wire being different from the communication line and the first electric wire.

4. The refrigeration cycle system according to claim 2, further comprising:

a signal line connecting between the utilization-side unit and the refrigerant sensor to allow communication between the utilization-side unit and the refrigerant sensor, the utilization-side unit and the heat source-side unit being prohibited from operation in a case in which the utilization-side unit is not connected to the refrigerant sensor via the signal line.

5. The refrigeration cycle system according to claim 2, wherein an operation prohibition signal in order to prohibit the operation of the heat source-side unit is sent to the heat source-side unit via the communication line in a case in which the utilization-side unit is not connected to the safety device via the first electric wire.

6. The refrigeration cycle system according to claim 2, further comprising:

a notification unit configured to make a notification that the heat source-side unit is prohibited from operation.

7. The refrigeration cycle system according to claim 1, further comprising:

a second electric wire for control of an operation of the safety device, the second electric wire connecting between the utilization-side unit and the safety device, and the second electric wire being different from the communication line and the first electric wire.

8. The refrigeration cycle system according to claim 7, further comprising:

a signal line connecting between the utilization-side unit and the refrigerant sensor to allow communication between the utilization-side unit and the refrigerant sensor, the utilization-side unit and the heat source-side unit being prohibited from operation in a case in which the utilization-side unit is not connected to the refrigerant sensor via the signal line.

9. The refrigeration cycle system according to claim 7, wherein an operation prohibition signal in order to prohibit the operation of the heat source-side unit is sent to the heat source-side unit via the communication line in a case in which the utilization-side unit is not connected to the safety device via the first electric wire.

10. The refrigeration cycle system according to claim 7, further comprising:

a notification unit configured to make a notification that the heat source-side unit is prohibited from operation.

11. The refrigeration cycle system according to claim 1, further comprising:

a signal line connecting between the utilization-side unit and the refrigerant sensor to allow communication between the utilization-side unit and the refrigerant sensor, the utilization-side unit and the heat source-side unit being prohibited from operation in a case in which the utilization-side unit is not connected to the refrigerant sensor via the signal line.

12. The refrigeration cycle system according to claim 11, wherein an operation prohibition signal in order to prohibit the operation of the heat source-side unit is sent to the heat source-side unit via the communication line in a case in which the utilization-side unit is not connected to the safety device via the first electric wire.

13. The refrigeration cycle system according to claim 11, further comprising:

a notification unit configured to make a notification that the heat source-side unit is prohibited from operation.

14. The refrigeration cycle system according to claim 1, wherein an operation prohibition signal in order to prohibit the operation of the heat source-side unit is sent to the heat source-side unit via the communication line in a case in which the utilization-side unit is not connected to the safety device via the first electric wire.

15. The refrigeration cycle system according to claim 14, further comprising:

a notification unit configured to make a notification that the heat source-side unit is prohibited from operation.

16. The refrigeration cycle system according to claim 1, further comprising:

a notification unit configured to make a notification that the heat source-side unit is prohibited from operation.

* * * * *